US011530829B2

(12) United States Patent
Long et al.

(10) Patent No.: US 11,530,829 B2
(45) Date of Patent: Dec. 20, 2022

(54) OVERFLOW SENSOR ASSEMBLY IN TEMPERATURE CONTROL SYSTEMS

(71) Applicant: Rheem Manufacturing Company, Atlanta, GA (US)

(72) Inventors: Robert L. Long, Fort Smith, AR (US); Kenneth D. Frederick, Fort Smith, AR (US); Kevin M. Ray, Fort Smith, AR (US); Karl S. Tallakson, Greenwood, AR (US); Sivakumar Gopalnarayanan, Plano, TX (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 320 days.

(21) Appl. No.: 16/684,224

(22) Filed: Nov. 14, 2019

(65) Prior Publication Data

US 2020/0149765 A1 May 14, 2020

Related U.S. Application Data

(60) Provisional application No. 62/767,400, filed on Nov. 14, 2018.

(51) Int. Cl.
*F24F 11/32* (2018.01)
*F24F 13/22* (2006.01)

(52) U.S. Cl.
CPC ..... *F24F 11/32* (2018.01); *F24F 13/222* (2013.01); *F24F 2013/227* (2013.01)

(58) Field of Classification Search
CPC .. F25D 29/005; F25D 2700/10; F25D 11/022; F25D 17/062; F25D 17/067; F25D 17/042; F25D 19/00; F25D 23/006; F25D 25/02; G01K 1/14; G01K 1/08; G01K 2205/04; G01K 7/22; G01K 13/02; G01K 1/143; G01K 1/16; G01K 2201/00; G01K 13/00; G01K 1/026; G01K 1/12; G01K 1/146; G01K 2007/163; G01K 2205/00; G01K 13/026; G01K 2013/026; G01K 7/18; G06F 12/0623; G11C 11/005; G11C 5/00; G11C 5/066; G11C 8/12; F25B 2700/21174; F25B 2700/21175;
(Continued)

(56) References Cited

U.S. PATENT DOCUMENTS 3,088,016 A * 4/1963 Mertler ..... F24C 15/104 219/448.14
4,037,427 A * 7/1977 Kramer ..... F25D 21/02 62/128

(Continued)

*Primary Examiner* — Filip Zec
(74) *Attorney, Agent, or Firm* — Eversheds Sutherland (US) LLP

(57) ABSTRACT

In one embodiment, an overflow sensor assembly of an HVAC unit includes a sensor mounting bracket that is configured to be coupled to a mounting surface of the HVAC unit such that sensor probes of the overflow sensor assembly are suspended within and extend into a condensate drain pan of the HVAC unit. The sensor probes are defined by a sensor element that is coupled to the sensor mounting bracket and a spring that is coupled to the sensor element. The sensor probes are configured to activate an overflow detection circuit when the sensor probes come in contact with condensate fluid collected in the condensate drain pan prior to the condensate fluid overflowing from the condensate drain pan.

20 Claims, 9 Drawing Sheets

(58) Field of Classification Search
CPC ..... F25B 2313/0314; F25B 2313/0315; F25B 2700/21162; F25B 2700/21163; A23G 1/21; A23G 3/0263; A23G 3/2023; A23G 4/04
USPC ..... 62/285–291
See application file for complete search history.

(56) References Cited

U.S. PATENT DOCUMENTS 4,075,863 A * 2/1978 Wilson ..... F25C 5/10 62/352
5,027,610 A * 7/1991 Hara ..... F25C 5/10 62/135
5,212,958 A * 5/1993 Anderson ..... B01D 5/009 417/36
5,984,281 A * 11/1999 Hacker ..... F02B 63/02 137/382
6,257,758 B1 * 7/2001 Culbertson ..... G01K 1/143 374/120
8,156,956 B1 * 4/2012 Coogle ..... F16L 55/07 137/271
9,469,517 B2 * 10/2016 Willis ..... F25D 11/02
9,644,887 B2 * 5/2017 Chung ..... F25D 17/067
10,113,916 B2 * 10/2018 Hong ..... G01K 1/143
2006/0208912 A1 * 9/2006 Fiorletta ..... G08B 21/20 340/605
2007/0169501 A1 * 7/2007 Rios ..... F24F 13/222 62/286
2008/0245802 A1 * 10/2008 Gray ..... F24F 13/222 220/571
2009/0026894 A1 * 1/2009 Lesmeister ..... H02K 11/25 310/68 C
2010/0052921 A1 * 3/2010 Cantolino ..... F24F 13/222 340/620
2011/0061415 A1 * 3/2011 Ward ..... F04B 49/04 62/291
2013/0218483 A1 * 8/2013 Sawyer ..... F28F 25/00 702/35
2015/0233769 A1 * 8/2015 Ishikawa ..... G01K 1/14 374/185
2015/0323241 A1 * 11/2015 Oakner ..... F24F 13/222 62/150
2016/0123651 A1 * 5/2016 Barbely ..... F24F 13/222 62/291
2018/0108461 A1 * 4/2018 Rostron ..... H01C 7/12
2020/0011740 A1 * 1/2020 Mohammad ..... F24F 1/22
2020/0393306 A1 * 12/2020 Yoshihara ..... G01K 1/08

* cited by examiner

OVERFLOW SENSOR ASSEMBLY IN TEMPERATURE CONTROL SYSTEMS

CROSS-REFERENCE TO RELATED APPLICATIONS

The present application claims priority to U.S. Provisional Patent Application No. 62/767,400 filed Nov. 14, 2018. The full disclosure of the foregoing application is incorporated by reference herein in its entirety and for all purposes.

TECHNICAL FIELD

The present disclosure relates generally to temperature control systems, and more particularly to an overflow sensor assembly in a temperature control system, such as a heating, ventilation, and air-conditioning (HVAC) unit.

BACKGROUND

Conventional HVAC units utilize a drain pan for collection and removal of condensation. Condensation may refer to the water formed on the evaporator coil during the operation of the HVAC units, e.g., air conditioning operation. The drain pan is typically situated below the evaporator coil to collect the condensate and direct the condensate fluid to a drain, e.g., via a condensate drain line. Unfortunately, over a period of time the drain line may become clogged due to algae, fungus, airborne debris entering the line, house settling, and so forth. If the drain lines clog, the condensate fluid may start to fill the drain pan. If left undetected, the condensate fluid may overflow the drain pan and cause costly structural and property damage, e.g., damage to household goods, furnishings, floors, carpet, walls, ceiling of the structure, etc., as well as damage to the HVAC units (e.g., blower motor).

Typically, conventional HVAC units are provided with a float switch that is either coupled to or disposed in the drain pan to detect the rising level of the condensate fluid in the drain pan and shut off the HVAC unit prior to an overflow of the condensate fluid from the drain pan. Shutting off the HVAC unit stops any further production of condensate fluid, thereby preventing the overflow of the condensate fluid from the drain pan and any resultant structural or property damages. The float switch can be used when the drain pan is a fixed drain pan. However, when the drain pan is configured to be removable, for example configured to slide in and out for easy cleaning, maintenance, and/or troubleshooting, the float switch may interfere with removal of the drain pan and/or may get damaged. For example, when the removable drain pan slides out, a portion of the drain pan may engage or strike the float switch causing the drain pan to get stuck, thereby preventing an easy or smooth removal from and/or insertion of the drain pan to the HVAC unit. Further, when the drain pan engages or strikes said float switch, the positioning of the float switch may be altered, or the lead wires to the float switch may get disconnected, and/or the float switch may get damaged.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure relates to an overflow sensor assembly of an HVAC unit. The overflow sensor assembly includes a sensor mounting bracket that is configured to be coupled to a mounting surface on the HVAC unit such that sensor probes that are disposed thereon are suspended within and extend into a condensate drain pan of the HVAC unit. The sensor probes are configured to activate an overflow detection circuit when the sensor probes come in contact with condensate fluid collected in the condensate drain pan prior to the condensate fluid overflowing from the condensate drain pan. Each sensor probe is defined by a sensor element and a spring that is coupled to the sensor element.

In another aspect, the present disclosure relates to an overflow sensor assembly of an HVAC unit. The overflow sensor assembly includes a sensor mounting bracket that is configured to be coupled to a mounting surface on the HVAC unit. Further, the overflow sensor assembly includes a first sensor probe defined by a portion of the sensor mounting bracket, and a second sensor probe defined by a termination of a wire that is coupled to the sensor mounting bracket using wire tabs. The portion of the sensor mounting bracket and the termination of the wire are suspended within and extend into a condensate drain pan of the HVAC unit and are configured to activate an overflow detection circuit when the sensor mounting bracket and the termination of the wire come in contact with condensate fluid collected in the condensate drain pan prior to the condensate fluid overflowing from the condensate drain pan.

In yet another aspect, the present disclosure relates to an HVAC apparatus that includes a condensate drain pan assembly. The condensate drain pan assembly is disposed in a drain pan cavity of the HVAC apparatus to collect condensate from an evaporator of the HVAC apparatus. The condensate drain pan is configured to slide in and slide out of the drain pan cavity. Further, the HVAC apparatus includes an overflow sensor assembly that is coupled to a frame of the HVAC apparatus such that at least one sensor probe of the overflow sensor assembly is suspended within and extends into the condensate drain pan of the HVAC apparatus to activate an overflow detection circuit when the at least one sensor probe encounters condensate fluid collected in the condensate drain pan prior to the condensate fluid overflowing from the condensate drain pan, wherein the overflow sensor assembly is flexible.

These and other aspects, features, and embodiments of the disclosure will become apparent to a person of ordinary skill in the art upon consideration of the following brief description of the figures and detailed description of illustrated embodiments.

BRIEF DESCRIPTION OF THE FIGURES

The foregoing and other features and aspects of the present disclosure are best understood with reference to the following description of certain example embodiments, when read in conjunction with the accompanying drawing, wherein.

Figure 1:
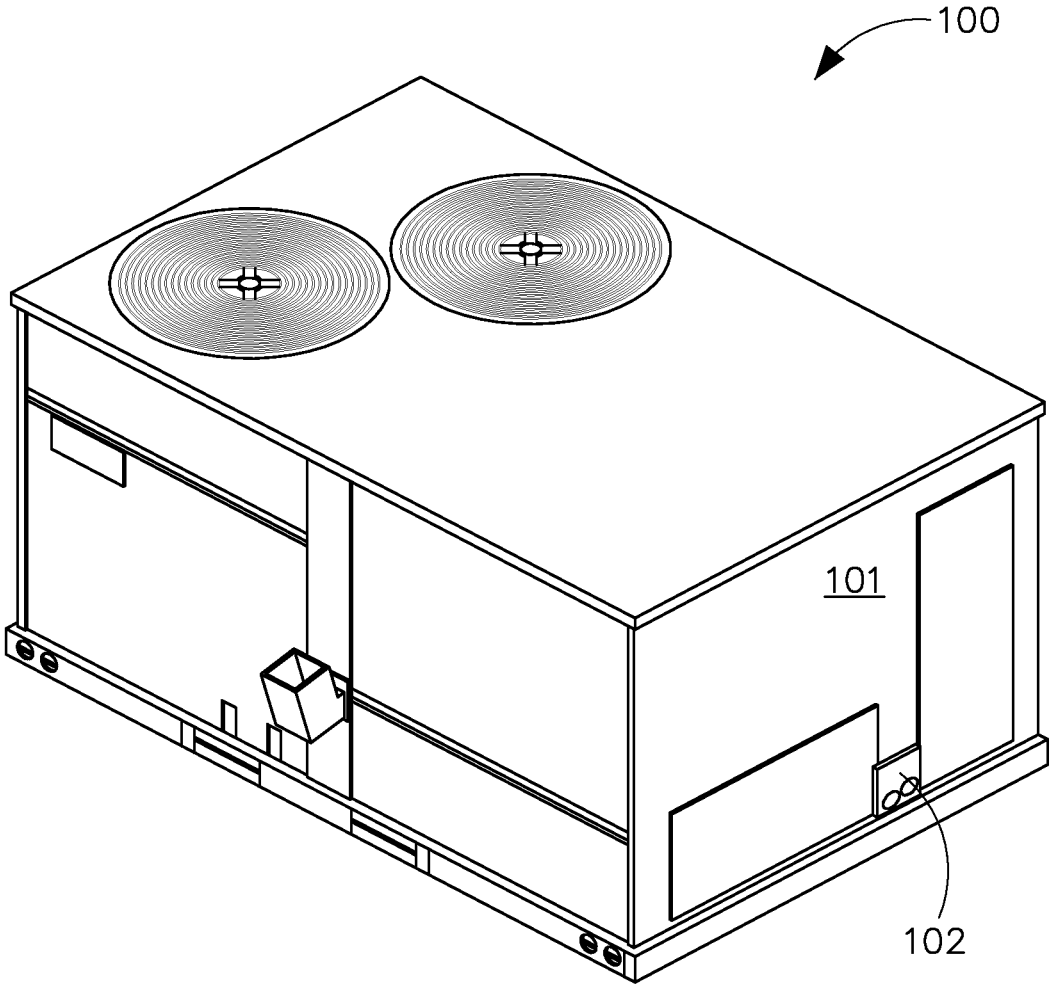
FIG. 1 illustrates a perspective front view of an example HVAC unit, in accordance with example embodiments of the present disclosure.
Figure 2:
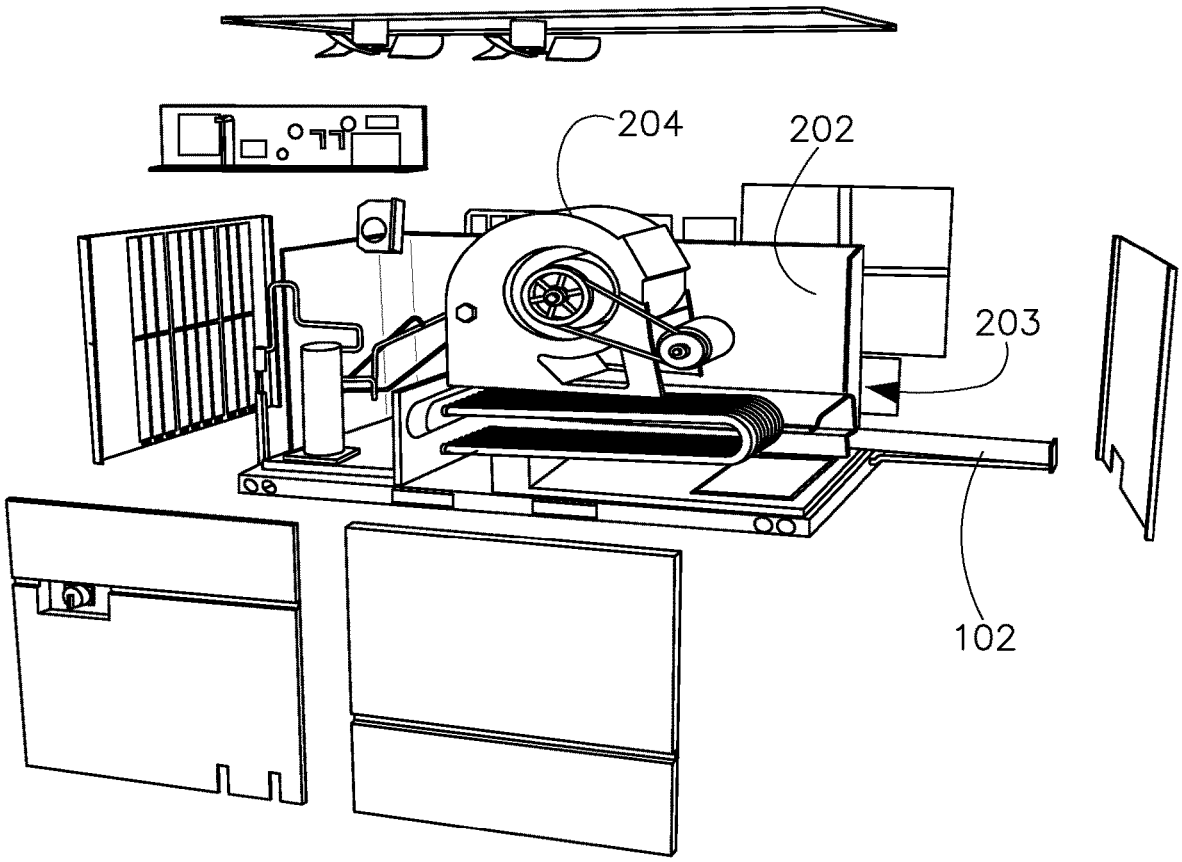
FIG. 2 is an exploded view of a portion of the HVAC unit of FIG. 1, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis is instead placed on clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes an overflow sensor assembly that is disposed in a removable condensate drain pan of an HVAC unit to detect a level of condensate in the drain pan and determine if the condensate in the drain pan is near overflow. In certain embodiments, the overflow sensor assembly is flexible to allow the removable condensate drain pan to be easily removed, e.g., to slide in and out. In one such embodiment, the overflow sensor assembly includes probes that are suspended from a bracket that is mounted above the drain pan, where the probes are configured to sense condensate (e.g., water) through electrical continuity. The probes may be screws with metal springs that are coupled thereto and extending from the screws such that the metal springs move when it interferes or engages with the removable drain pan.

Example embodiments of an HVAC unit with the overflow sensor assembly will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The overflow sensor assembly of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the overflow sensor assembly of the present disclosure can be disposed in an HVAC unit that is located in any type of environment (e.g., warehouse, attic, garage, storage, mechanical room, basement) for any type (e.g., commercial, residential, industrial) of user. Furthermore, even though the present disclosure describes the overflow sensor assembly as being used in HVAC units, one of skill in the art can understand and appreciate that the overflow sensor assembly can be used with any other appropriate temperature control systems that has removable drain pans for collecting condensate and sensor probes for detecting a condensate overflow condition without departing from a broader scope of the present disclosure. Referring to FIGS. 1-5 and 8, an HVAC unit 100 of the present disclosure may include a removable drain pan assembly 102 that is configured to be disposed in a drain pan cavity 310 (illustrated in FIG. 3) that is located below evaporator coils 202 of the HVAC unit 100. The drain pan assembly 102 may be configured to slide in and slide out of a drain pan cavity 310. In certain embodiments, the removable drain pan assembly 102 may include a drain pan front cover 304, a condensate drain pan 302, and a drain line 305. The drain pan front cover 304 may be configured to provide leverage to a user to pull or slide out the removable drain pan assembly 102 from the drain pan cavity 310 as desired, e.g., for cleaning, maintenance, etc. The condensate drain pan 302 may be configured to collect condensate from the evaporator coils 202 in a cavity 312 defined by the condensate drain pan 302. Further, the condensate drain pan 312 may be configured to direct the collected condensate fluid to a drain on the side of the HVAC unit 100, e.g., via the drain line 305.

In addition to the drain line 305, the removable drain pan assembly 102 may include a center drain tube 306. In some example embodiments, the drain line 305 may be coupled to the center drain tube 305 using a connector tube (not shown) to drain the condensate fluid collected in the condensate drain pan 302 though an opening below the HVAC unit 100.

Figure 3A:
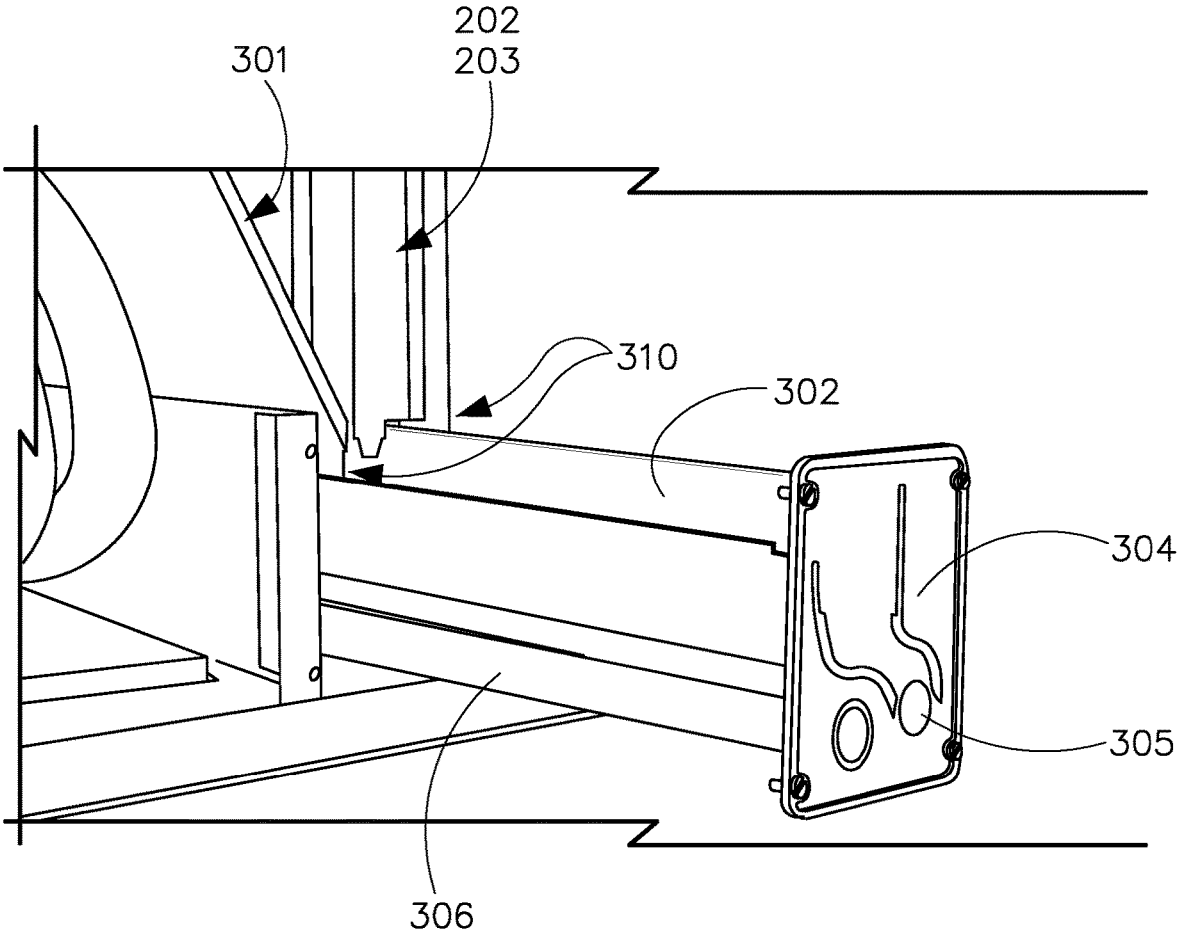
FIGS. 3A and 3B (collectively 'FIG. 3') illustrate an example removable drain pan assembly of the HVAC unit of FIG. 1 with the overflow sensor assembly disposed therein, in accordance with example embodiments of the present disclosure.

As illustrated in FIG. 3, one end of the drain pan 302 may be coupled to a hook end 402 of a blower deck 301 that is configured to support the blower fan assembly 204 thereon, while the other end of the drain pan 302 is coupled to a flange 404 of an evaporator assembly frame 203. In certain embodiments, the hook end 402 may be a substantially J-shaped end portion of the blower deck 301 as illustrated in FIG. 3. The hook end 402 of the blower deck 301 and the flange 404 of the evaporator assembly frame 203 may be disposed in the drain pan cavity 310.

Figure 3B:
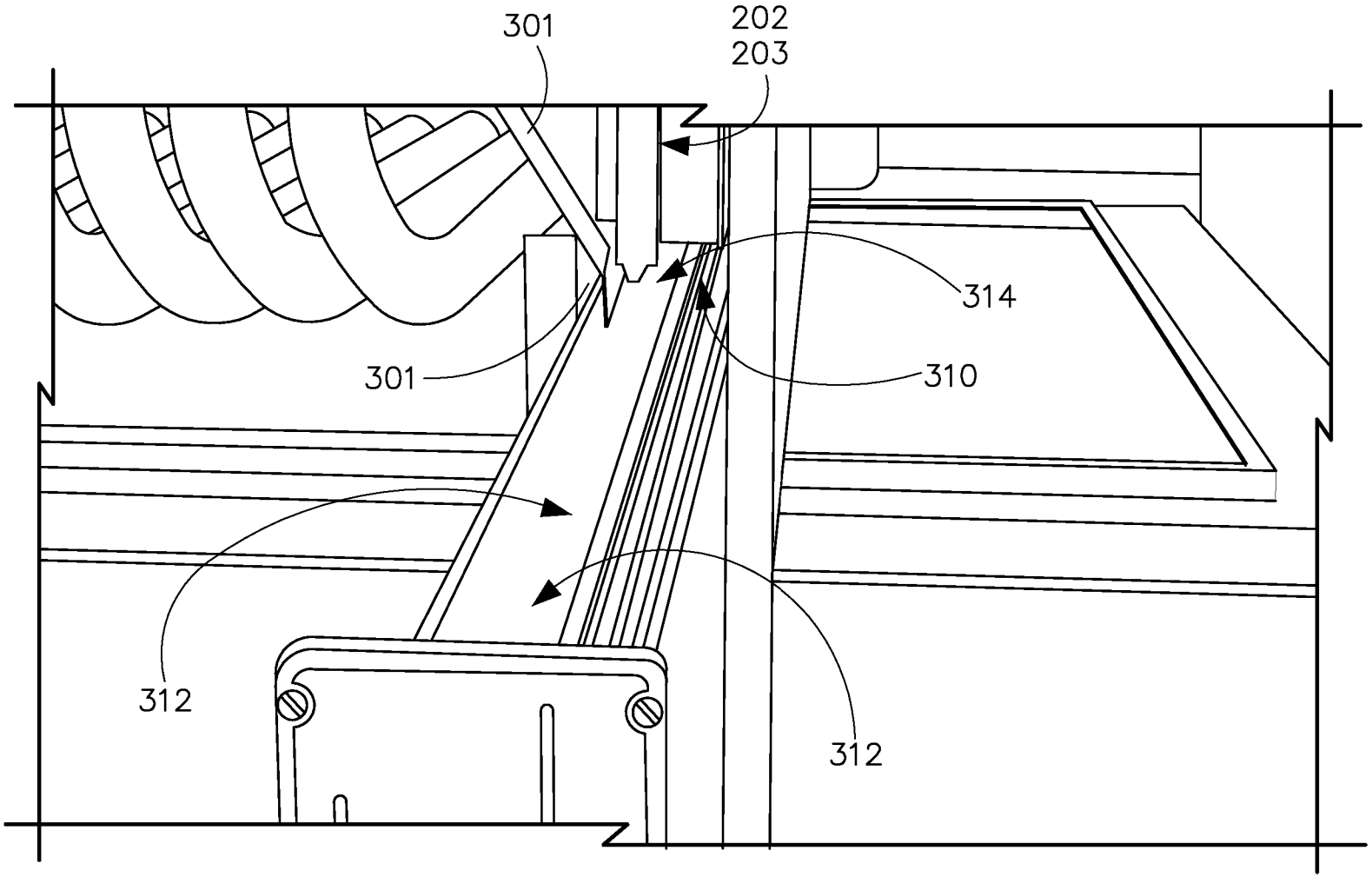

In addition to the removable drain pan assembly 102, the HVAC unit 100 of the present disclosure may include an overflow sensor assembly 314 that is coupled to the hook end 402 of the blower deck 301 such that the sensor probes 411 of the overflow sensor assembly 314 may be disposed in and extend to a certain depth within the condensate drain pan 302 as illustrated in FIG. 3B. In particular, the overflow sensor assembly 314 may include a sensor mounting bracket 406 that is coupled to the hook end 402 of the blower deck 301 using a fastener, such as a screw 313.

Figure 5:
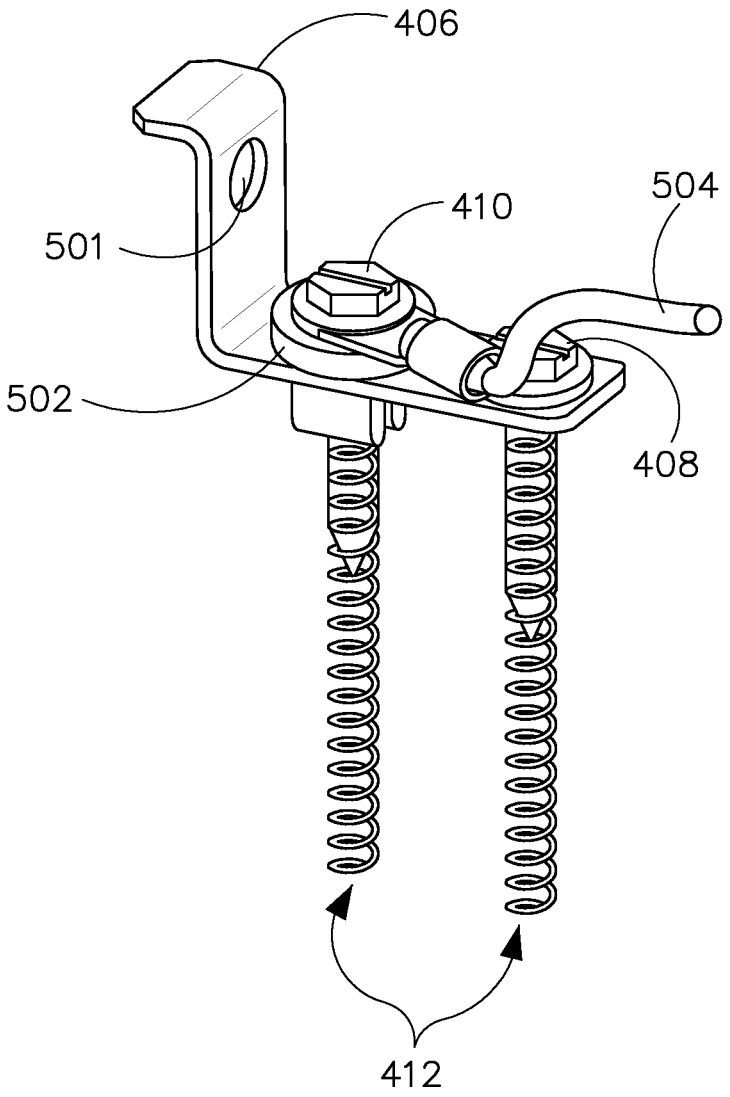
FIG. 5 illustrates a first example overflow sensor assembly that is flexible to accommodate the removable drain pan assembly, in accordance with example embodiments of the present disclosure.

As illustrated in FIG. 5, the sensor mounting bracket 406 may include an aperture 501 that is configured to receive the fastener 313 therethrough to couple the sensor mounting bracket 406 to an appropriate mounting surface (e.g., the hook end 402 of the blower deck 301) that allows the sensor probes 411 of the overflow sensor assembly 314 to be disposed within the condensate drain pan 302. Even though the present disclosure describes the sensor mounting bracket 406 as being coupled to the hook end 402 of the blower deck 301, one of skill in the art can understand and appreciate that in other example embodiments, the sensor mounting bracket 406 of the overflow sensor assembly 314 may be mounted at any appropriate location above the condensate drain pan 302 such that the sensor probes 411 of the overflow sensor assembly 314 are disposed at a depth within the condensate drain pan 302 to sense a rising condensate fluid level in the condensate drain pan 302 prior to an overflow of the condensate fluid from the condensate drain pan 302.

Figure 4:
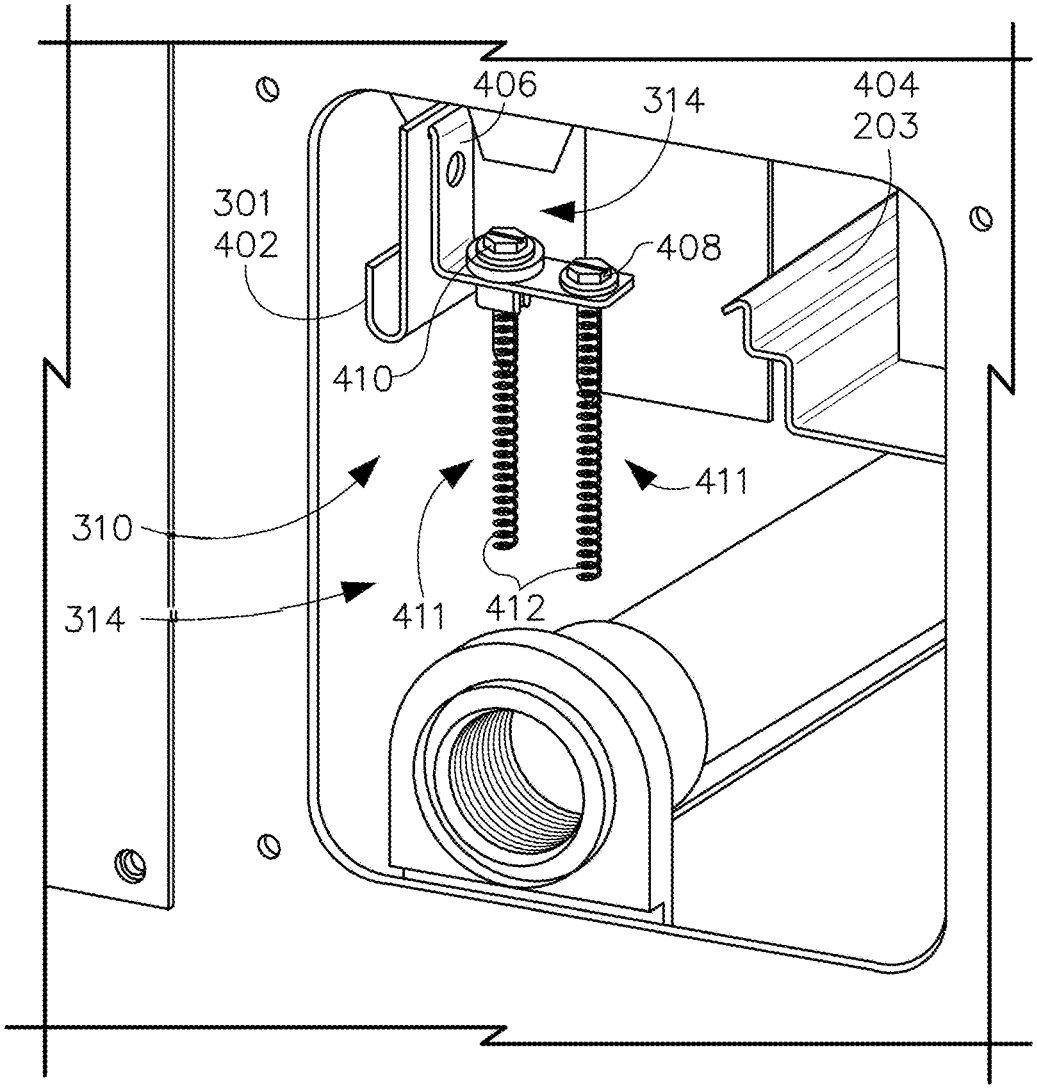
FIG. 4 illustrates an enlarged view of drain pan cavity of the HVAC unit of FIG. 1 with the removable drain pan assembly having been removed, in accordance with example embodiments of the present disclosure.

In certain embodiments, the sensor mounting bracket 406 may be a substantially L-shaped bracket as illustrated in FIGS. 4 and 5. In such embodiments, one leg of the L-shaped bracket may be used to mount the sensor mounting bracket 406 to an appropriate mounting surface as described above, while the other leg of the L-shaped bracket may be configured to support and mount the sensor probes 411 thereon. The sensor probes 411 of the overflow sensor assembly 314 may be configured to close an overflow sensing circuit or create circuit continuity when the sensor probes 411 come in contact with the condensate fluid. Closing the overflow sensing circuit when the sensor probes 411 contact the condensate fluid may in turn cause an overflow alert signal (or alarm) to be generated and transmitted to the HVAC unit 100. Additionally, in some embodiments, the operation of the HVAC unit 100 may be shut off to prevent further generation of condensate fluid when the overflow sensing circuit is closed.

In one example embodiment, as illustrated in FIGS. 3B, 4, and 5, the sensor probes 411 may include a pair of screws (408, 410) that extend through corresponding openings in the sensor mounting bracket 406 and/or metal springs 412 that are threaded to the screws (408, 410). The first screw 410 may be coupled to a power supply, e.g., 24 V power supply via a wire assembly 504, while the second screw 408 may be grounded. The metal springs 412 (e.g., helical springs) may be threaded to the screws until the metal springs on both the screws (408, 410) have an equal insertion depth and are flush across the bottom. The metal springs 412 may be adjusted, e.g., rotated clockwise or anti-clockwise, to adjust the insertion depth at which the bottom tips of the metal springs 412 are disposed. The insertion depth at which the bottom tips of the metal springs 412 are disposed may determine the depth or the level at which the condensate fluid in the condensate drain pan 302 will be detected and cause the overflow sensing circuit to close and shut down the operation of the HVAC unit 100. Shutting down the operation of the HVAC unit 100 may include shutting down a current operation cycle, e.g., a current heating or cooling cycle of the HVAC unit 100.

The first screw 410 that is coupled to the power supply via the wire assembly 504 may be coupled to the sensor mounting bracket 406 of the overflow sensor assembly 314 via a grommet nut 502, e.g., nylon grommet nut such that the first screw 410 is raised or positioned at a higher level than the second screw 408. In certain embodiments, placing the first screw 410 at a higher level or elevation than the second screw 408 using the grommet nut 502 may prevent a false overflow detection from any condensate fluid that drips on the sensor mounting bracket 406 between the screw heads of the sensor probes 411.

The metal springs 412 that are threaded to the screws (408, 410) operate as an extension of the sensor probes 411. That is, the tip of the metal springs 412 may define the tip of the sensor probes 411. In addition to operating as the extension of the sensor probes 411, the metal springs 412 make the sensor probes 411 flexible to allow the removable drain pan assembly 102 to easily slide in and slide out. For example, if any portion of the condensate drain pan 302 engages the metal springs 412 of the sensor probes 411, the metal springs 412 may deflect to allow said portion of the condensate drain pan to move past the sensor probes 411 and then the metal springs 412 return back to their default position as illustrated in FIGS. 3B, 4, and 5. In other words, the metal springs 412 of the sensor probes 411 move or deflect if there is any interference with the sliding removable drain pan assembly 102 to allow the removable drain pan assembly 102 to slide past the sensor probes 411.

Figure 6:
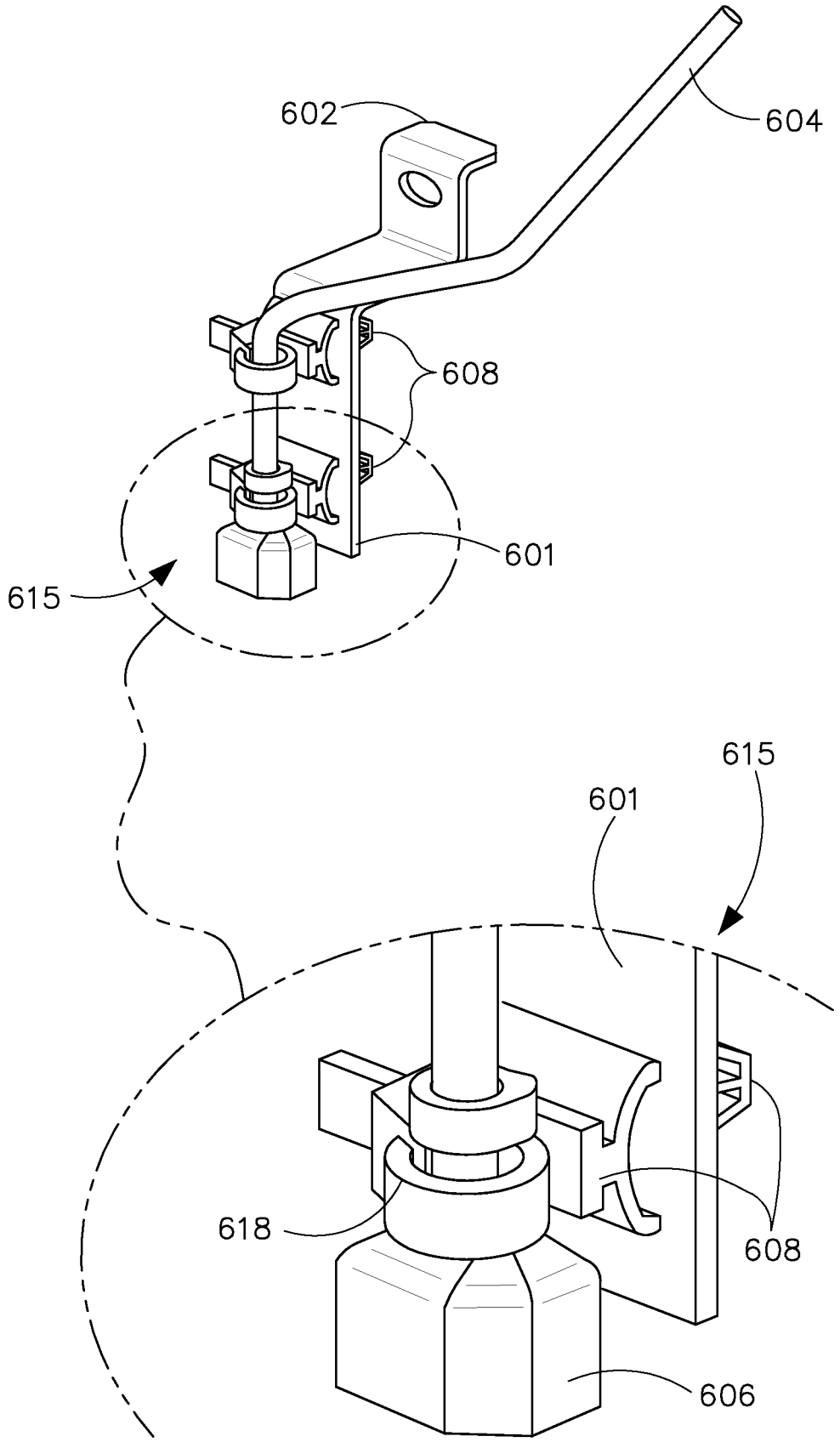
FIG. 6 illustrates a second example overflow sensor assembly that is rigidly mounted to a flexible mount to accommodate the removable drain pan assembly, in accordance with example embodiments of the present disclosure.

Even though FIGS. 3B, 4, and 5 illustrate an overflow sensor assembly 314 having metal springs 412 that are flexible, one of skill in the art can understand and appreciate that in other example embodiments, the sensor probes 411 may not include the metal springs 412 provided the removal of the removable drain pan assembly 102 does not interfere with the sensor probes 411 of the overflow sensor assembly 314. For example, the sensor probes 411 of the overflow sensor assembly 314 illustrated in FIGS. 3B, 4, and 5 may not include the metal springs 412. Instead, the sensor probes 411 may only include the screws (408, 410). In another example embodiment illustrated in FIG. 6, the overflow sensor assembly 314 may include sensor probes that are defined by: (i) a metal leg 601 that is coupled or integral to and extending down from an edge of the substantially L-shaped sensor mounting bracket 602, and (ii) a wire 604 that is coupled to the metal leg 601 using wire tabs or stand-off tabs 608 such that the wire is separated from the metal leg 601 by a distance and extends down into the condensate drain pan 302. The wire 604 includes a termination 606 at the end. The termination 606 at the end of the wire 604 forms one probe while the metal leg 601 forms the other probe that create circuit continuity when the termination 606 and the metal leg 601 contact the condensate fluid in the condensate drain pan 302. In certain example embodiments, one of the wire tabs or stand-off tabs 608 may include a push mount tie that may be secured around a neck of the termination 606 to securely hold the termination in place, as shown in FIG. 6.

Figure 7A:
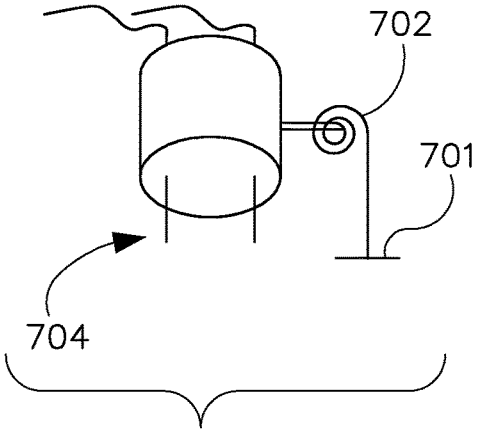
FIGS. 7A, 7B, 7C, and 7D (collectively 'FIG. 7') illustrate additional example overflow sensor assemblies that are flexible to accommodate the removable drain pan assembly, in accordance with example embodiments of the present disclosure.
Figure 7C:
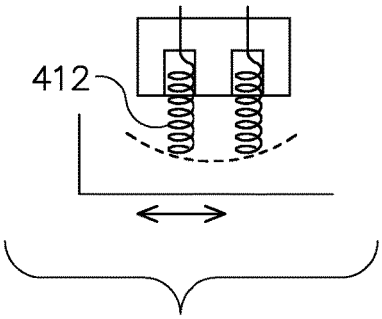
Figure 7B:
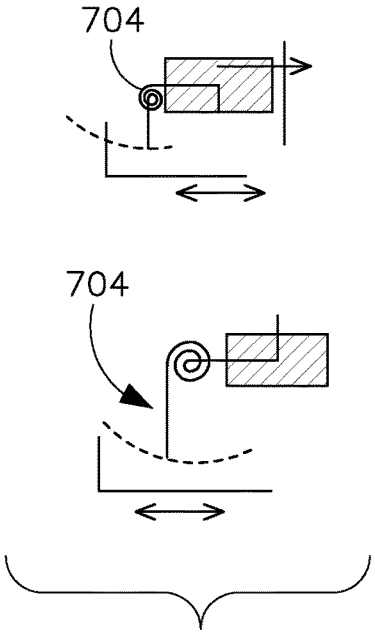
Figure 7D:
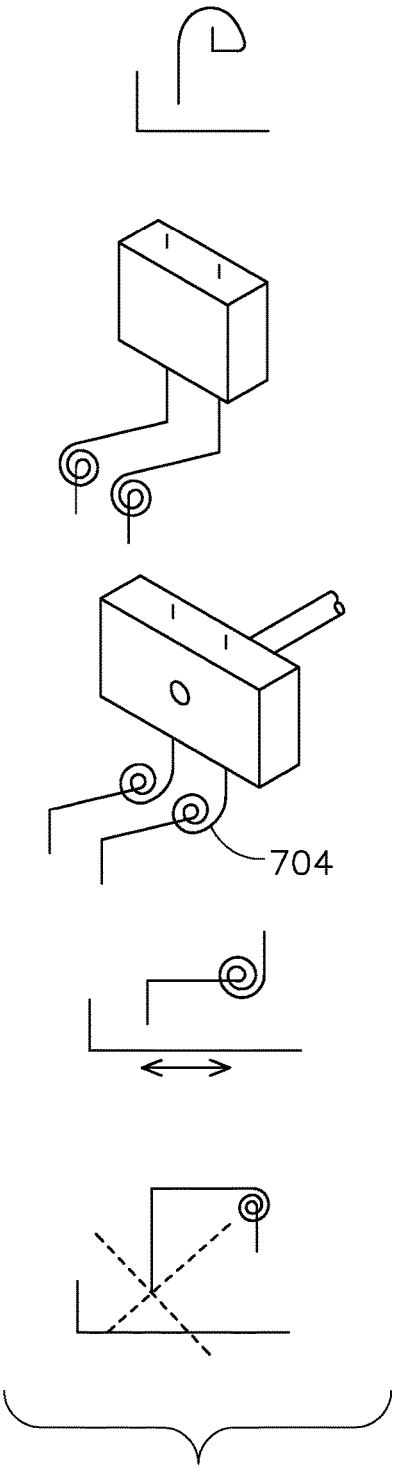
Figure 8:
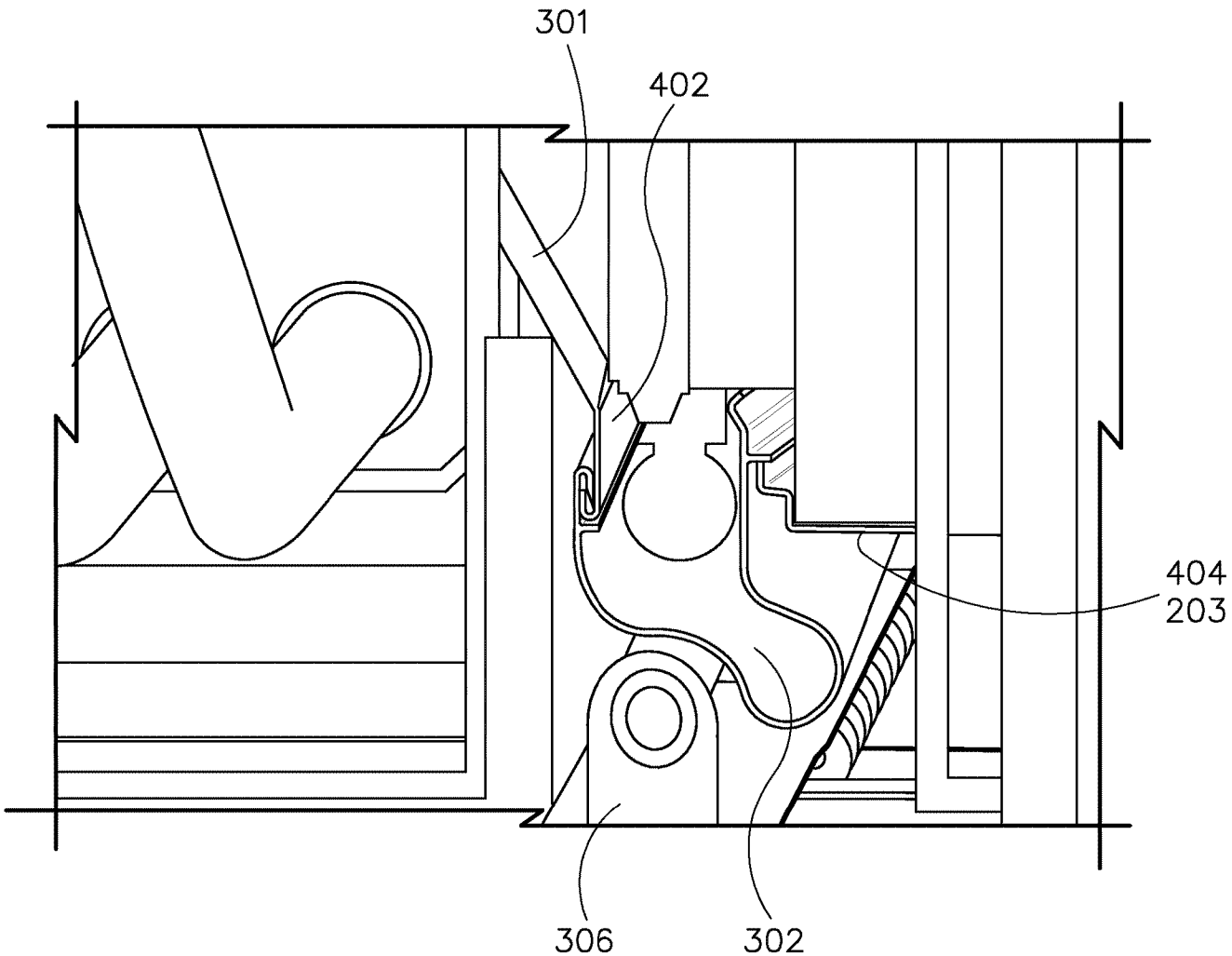
FIG. 8 illustrates a cross-sectional view of the removable drain pan assembly, in accordance with example embodiments of the present disclosure.

Even though FIGS. 3B, 4, and 5 illustrate an overflow sensor assembly 314 having metal springs 412 that are flexible and are threaded onto screws to form the sensor probes, in some example embodiments, as illustrated in embodiments B and D of FIGS. 7B and 7D, any other appropriate spring type 704, such as torsion springs may be coupled to the screws or other such sensor elements to form an extension of the sensor elements and to define the sensor probes. Further, even though FIGS. 3B, 4, and 5 illustrate an overflow sensor assembly 314 having metal springs 412 that are flexible and are threaded onto screws to form the sensor probes, in some example embodiments, such as the one illustrated in embodiment A of FIG. 7A, a rigid sensor 704 may be coupled to an end of a spring assembly 702 (e.g., torsion spring) that is mounted to a mounting bracket 701 at an opposite end. The spring assembly 702 may be configured to flex and deflect which in turn causes the rigid sensor probes 704 to move when they interfere with the sliding removable drain pan assembly 102.

Further, in some example embodiments, such as the embodiment illustrated in FIG. 7C, the sensor mounting bracket 406 may be pivotally coupled to the mounting surface or adjustably coupled to the mounting surface such that the sensor mounting bracket 406 can deflect about a mounting point on the mounting surface without departing from a broader scope of the present disclosure. In certain embodiments, the sensor mounting bracket 602 of FIG. 6 may be adjustably or pivotally coupled to the mounting surface (e.g., hook end 402 of the blower deck 301) or couple to the mounting surface via a torsion spring such as in embodiment A of FIG. 7A such that the sensor mounting bracket 602 and the termination 606 with the wire 604 rotate, move, or deflect if there is any interference with the sliding removable drain pan assembly 102 to allow the removable drain pan assembly 102 to slide past the sensor probes (606, 601).

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An overflow sensor assembly of a heating, ventilation, and air conditioning (HVAC) unit, the overflow sensor assembly comprising:

a first sensor probe configured to be in electrical communication with a power supply;

a second sensor probe configured to be in electrical communication with ground;

a sensor mounting bracket configured to attach to a mounting surface on the HVAC unit and suspend the first and second sensor probes within a condensate drain pan of the HVAC unit, wherein when the first and second sensor probes come in contact with a condensate fluid, the first and second sensor probes are configured to activate an overflow detection circuit comprising at least the condensate fluid.

2. The overflow sensor assembly of claim 1, wherein:

the first sensor probe comprises a first sensor element and a first spring configured to adjustably extend a length of the first sensor probe, and the second sensor probe comprises a second sensor element and a second spring configured to adjustably extend a length of the second sensor probe.

3. The overflow sensor assembly of claim 2, wherein the first sensor element is a first screw and the second sensor element is a second screw.

4. The overflow sensor assembly of claim 1, wherein the first sensor probe is coupled to the sensor mounting bracket by a grommet nut such that the first sensor probe is positioned at a higher level than the second sensor probe.

5. The overflow sensor assembly of claim 1, wherein the condensate drain pan is removable and is configured to slide in and slide out of a drain pan cavity that is disposed below an evaporator coil assembly of the HVAC unit.

6. The overflow sensor assembly of claim 2, wherein the first and second sensor elements of the first and second sensor probes are disposed on and mounted to the sensor mounting bracket, and wherein the first spring is coupled to the first sensor element and the second spring is coupled to the second sensor element.

7. The overflow sensor assembly of claim 2, wherein the first and second springs are disposed on and mounted to the sensor mounting bracket at one end, wherein the first sensor element is coupled to an opposite end of the first spring, and wherein the second sensor element is coupled to an opposite end of the second spring.

8. An overflow sensor assembly of a heating, ventilation, and air conditioning (HVAC) unit, the overflow sensor assembly comprising:

a sensor mounting bracket configured to attach to a mounting surface on the HVAC unit and suspend a first sensor probe and a second sensor probe within a condensate drain pan of the HVAC unit, wherein the first sensor probe defined by a portion of the sensor mounting bracket and configured to be electrical communication with a power supply, wherein the second sensor probe defined by a termination of a wire that is coupled to the sensor mounting bracket using wire tabs and configured to be in electrical communication with ground, wherein when the portion of the sensor mounting bracket and the termination of the wire come in contact with a condensate fluid, the portion of the sensor mounting the bracket and the termination of the wire are configured to activate an overflow detection circuit comprising at least the condensate fluid.

9. The overflow sensor assembly of claim 8, wherein the wire is spaced apart from the sensor mounting bracket by the wire tabs.

10. The overflow sensor assembly of claim 8, wherein the condensate drain pan is configured to slide in and slide out of a drain pan cavity that is disposed below an evaporator coil assembly of the HVAC unit.

11. The overflow sensor assembly of claim 8, wherein the sensor mounting bracket is adjustably coupled to the mounting surface on the HVAC unit.

12. A heating, ventilation, and air conditioning (HVAC) apparatus comprising:

a condensate drain pan assembly that is disposed in a drain pan cavity of the HVAC apparatus to collect condensate from an evaporator of the HVAC apparatus, the condensate drain pan assembly being configured to slide in and slide out of the drain pan cavity; and an overflow sensor assembly that is coupled to a frame of the HVAC apparatus such that a first sensor probe is configured to be in electrical communication with ground, wherein a sensor mounting bracket is configured to attach to a mounting surface of the HVAC apparatus and suspend the first sensor probe or the second sensor probe within the condensate drain pan of the HVAC apparatus, wherein when the first and second sensor probes encounters condensate fluid, the first and second sensor probes are configured to activate an overflow detection circuit comprising at least the condensate fluid.

13. The HVAC apparatus of claim 12, wherein the condensate drain pan assembly is disposed below an evaporator coil assembly of the HVAC apparatus.

14. The HVAC apparatus of claim 12, wherein the first sensor probe comprises a first sensor element with a first spring that is coupled to the first sensor element, and the second sensor probe comprises a second sensor element with a second spring that is coupled to the second sensor element.

15. The HVAC apparatus of claim 12, wherein the first sensor probe comprises a first sensor element and the second sensor probe comprises a second sensor element.

16. The HVAC apparatus of claim 12, wherein the first sensor probe is defined by a portion of the sensor mounting bracket, and wherein the second sensor probe is defined by a termination of a wire that is coupled to the sensor mounting bracket using wire tabs.

17. The HVAC apparatus of claim 15, wherein the sensor mounting bracket is pivotally coupled to the mounting surface on the HVAC apparatus.

18. The HVAC apparatus of claim 14, wherein the first sensor element is a first screw and the second sensor element is a second screw.

19. The HVAC apparatus of claim 14, wherein the first spring is configured to adjustably extend a length of the first sensor element and the second spring is configured to adjustably extend a length of the second sensor element.

20. The HVAC apparatus of claim 14, wherein the first sensor probe comprises a first screw and a first spring that is threaded to the first screw and the second sensor probe comprises a second screw and a second spring that is threaded to the second screw, and wherein the first screw is coupled to a wire that couples the first screw to a power supply and the second screw is grounded.

* * * * *